US005481988A

United States Patent [19]

Dess

[11] Patent Number: 5,481,988

[45] Date of Patent: Jan. 9, 1996

[54] TELESCOPING WORK PLATFORM

[76] Inventor: Daniel B. Dess, 2701 W. Bellfort Ave., #1303, Houston, Tex. 77054

[21] Appl. No.: 237,763

[22] Filed: May 4, 1994

[51] Int. Cl.[6] ..... A47B 9/00

[52] U.S. Cl. ..... 108/106; 280/47.26; 280/35; 108/193; 108/144

[58] Field of Search ..... 108/144, 106, 108/107, 110, 192, 193; 280/47.26, 47.35, 79.3, 35; 248/98; 182/62.5, 141

[56] References Cited

U.S. PATENT DOCUMENTS

| | | | |
|---|---|---|---|
| 2,762,659 | 9/1956 | Harlan et al. | 182/141 |
| 3,056,507 | 10/1962 | Squires, Jr. et al. | 108/106 |
| 3,157,386 | 11/1964 | Higgins | 182/141 |
| 3,953,044 | 4/1976 | Wilson | 280/79.3 X |
| 3,981,511 | 9/1976 | Foster | 280/79.3 |
| 4,302,023 | 11/1981 | Kiesz | 108/106 X |
| 4,441,734 | 4/1984 | Schlissel | 280/47.26 |
| 4,752,102 | 6/1988 | Rasmussen | 108/147 X |

FOREIGN PATENT DOCUMENTS

| | | | |
|---|---|---|---|
| 26324 | 11/1923 | France | 108/144 |
| 712941 | 10/1931 | France | 248/98 |
| 336487 | 10/1930 | United Kingdom | 248/98 |

*Primary Examiner*—Peter M. Cuomo
*Assistant Examiner*—Janet M. Wilkens
*Attorney, Agent, or Firm*—Bush, Moseley, Riddle & Jackson

[57] ABSTRACT

A telescoping work platform having telescoping inner and outer frames that are telescopically adjustable and are capable of being locked relative to one another. The inner frame has a bottom wall at its lower end which serves as a work platform and is provided at its upper end with safety rails for stabilization of the user. The outer frame is provided with pivotal ladder rungs to permit climbing by the user and to permit user access to the work platform at all selected positions of the inner and outer frames. The work platform is also provided with retractable transport wheels and wheel actuators to permit stable use of the work platform and to permit wheeled transport of the work platform when its movement is desired.

14 Claims, 2 Drawing Sheets

FIG.1
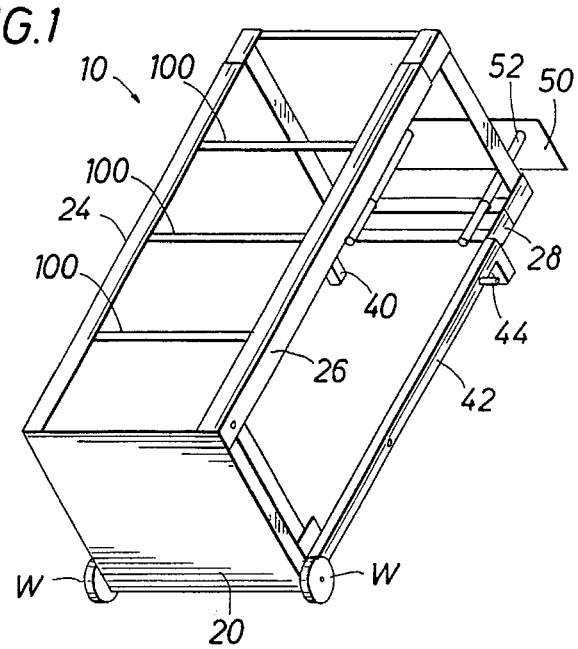
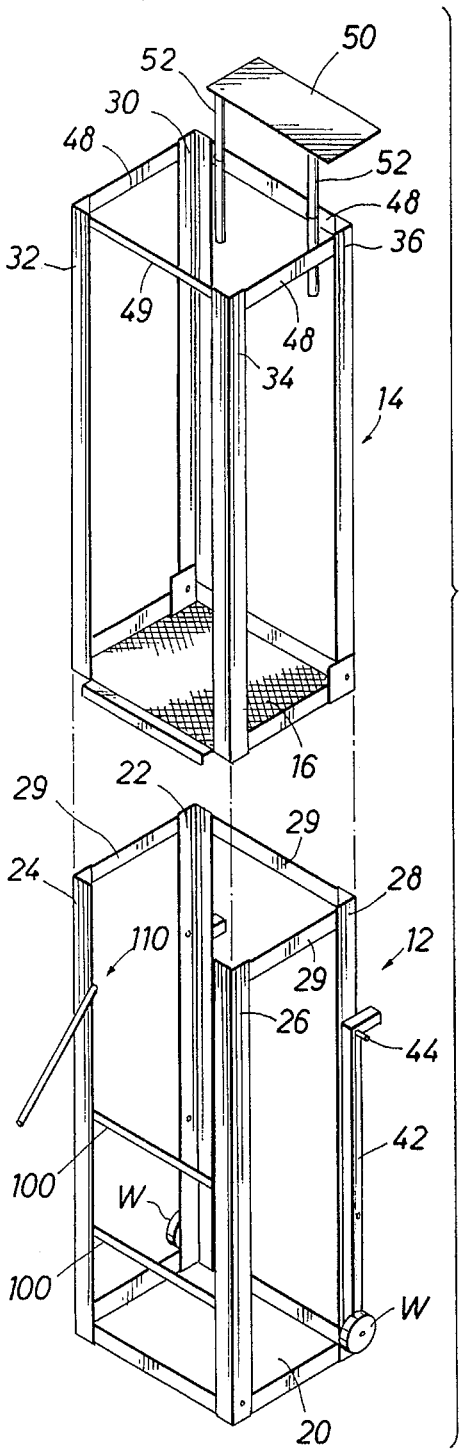
FIG. 2
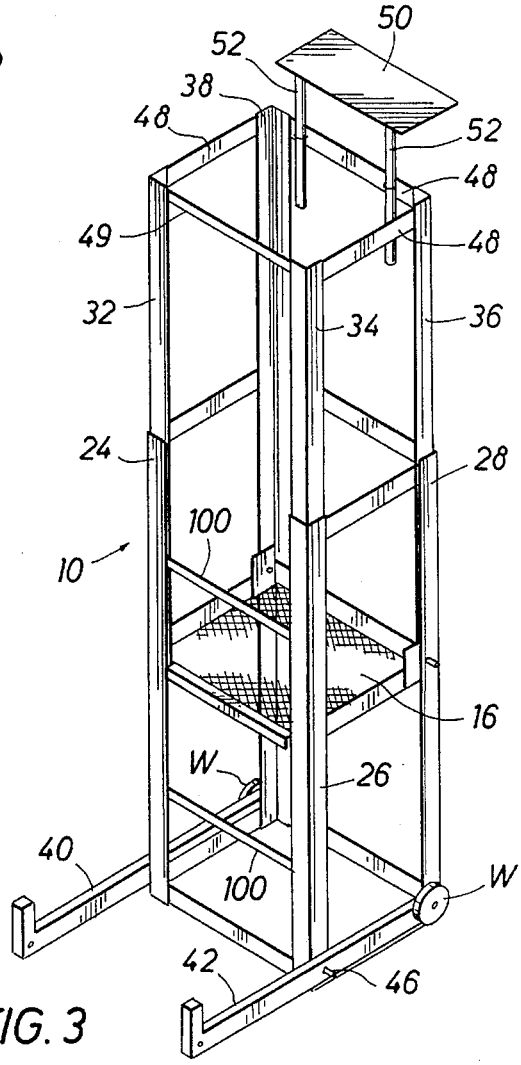
FIG. 3

FIG. 4
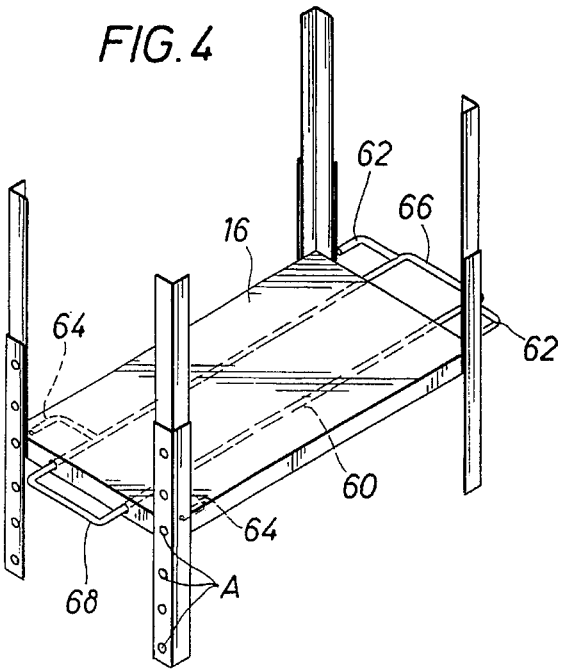
FIG. 5
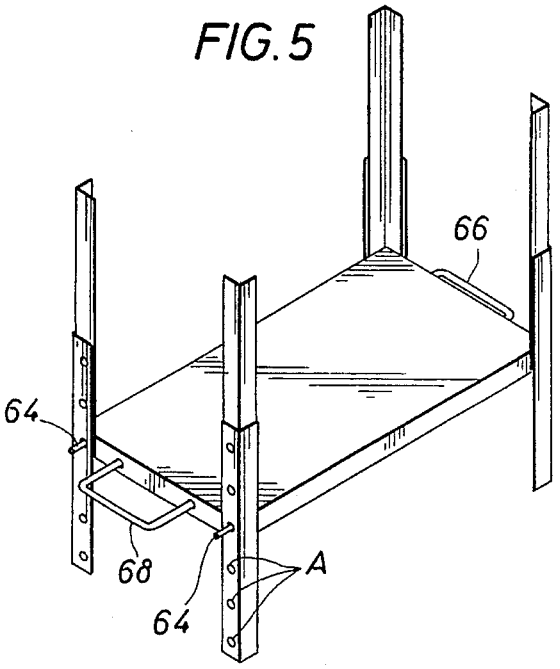
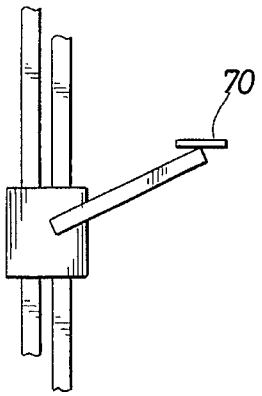
FIG. 6
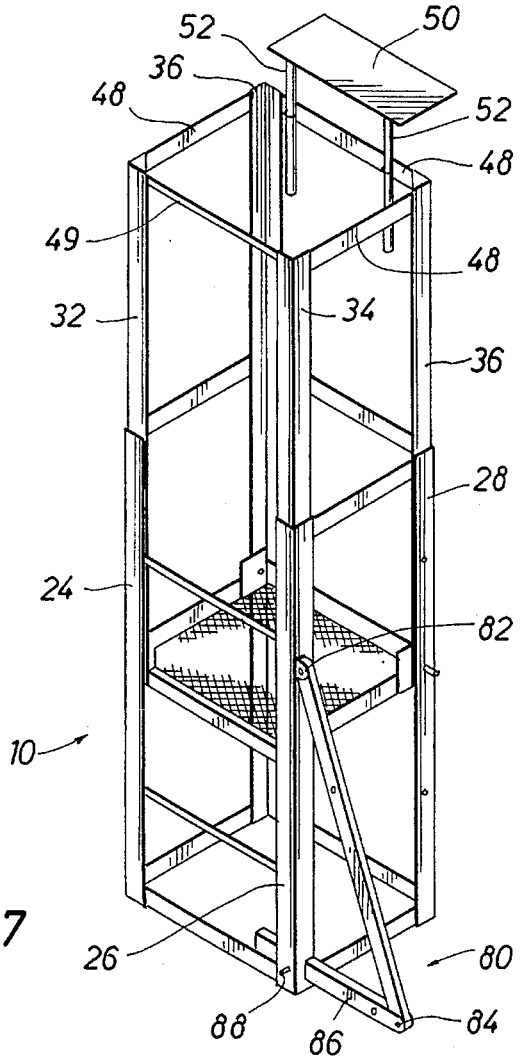
FIG. 7

TELESCOPING WORK PLATFORM

REFERENCE TO RELATED PUBLICATIONS

The present invention was registered in the United States Patent and Trademark Office under the Document Disclosure Program. The date received was Jun. 28, 1993 and the registration number is 334,259.

BACKGROUND OF THE INVENTION

1. Field of the Invention

The present invention relates to elevated work platforms. More specifically, it relates to a telescoping work platform. Even more specifically, it relates to a telescoping work platform where an inner basket that includes the work platform is entirely disposed within an outer, supporting basket structure.

2. Description of the Prior Art

When it is necessary for a person to work on an area some distance off the ground, there are a variety of devices that can aid them in reaching the position with the tools required to perform the work. One of the most common of these is the stepladder. There are a number of well-known drawbacks to the stepladder, however, one of the most common being that the user, at the limit of reach allowed by the height of the unfolded ladder, is in a precarious and potentially unbalanced position. Manufacturers of these ladder types are well aware of this danger and are at pains to make even a casual user aware of the danger by marking the highest Step of the ladder with a "DO NOT STAND ON THIS STEP" sign or other similar warning. Unfortunately, people being what they are, these warnings are ignored by some users and an unnecessary number of injuries are sustained every year. Another drawback to the conventional stepladder is that insufficient provision is made for the carrying of tools and their storage proximate the work site. The user of these conventional ladders is forced to lay tools down on the steps of the ladder, or on a folding platform attached thereto. In the case of heavy or bulky tools this can be dangerous, if not impossible. As will be explained later, the instant invention seeks to provide a superior alternative to the present devices available for accessing elevated work areas. During a search in this art area, a number of relevant patents were uncovered and they will be discussed hereinafter.

First, U.S. Pat. No. 2,310,119 issued on Feb. 2, 1943, to John P. Reinhardt, discloses an extensible ladder wherein a base supports a plurality of telescoping ladder segments with a platform mounted on the topmost segment. The device is raised and lowered within the limits set by integral travel stops by means of pulleys and a rope.

Another relevant patent is U.S. Pat. No. 3,473,627 issued on Oct. 21, 1969, to Ervin A. Repka. This discloses a portable tower where the device can be towed to a location and then rotated relative to the trailer portion such that the framework and the platform that it supports rests upright.

In U.S. Pat. No. 3,997,024 issued on Dec. 14, 1976, to Anthony T. Fredericks et al. there is disclosed a portable scaffold ladder wherein a pair of caster mounted members are connected by a horizontal platform member. Each of the caster mounted members is connected to the platform member by means of pivotable glide members that include leaf spring type locking pins to interlock the platform in relation to the end members. The pivot feature of the glide members allow the device to be collapsed for storage or transport when the locking pins are disengaged.

Lastly, U.S. Pat. No. 4,442,919 issued on Apr. 17, 1984, to Rodney D. Fulcher discloses a portable tower where a tongue assembly is provided to aid in towing the device to a desired location. When the location is reached, a winch is used to pivot the tower to an upright position.

None of the above inventions and patents, taken either singly or in combination, is seen to describe the instant invention as claimed.

SUMMARY OF THE INVENTION

The present invention is a telescoping work platform. The unit includes an outer frame or basket and an inner frame or basket that slides in vertical relationship with the outer basket. The floor of the inner basket serves as the work platform and the inner and outer baskets are provided with interengaging means to position the inner basket and work platform carried therewith at various predetermined heights. Integral wheeled transport means are disclosed in one embodiment along with a locking lug arrangement proximate the work platform for vertical positioning.

Accordingly, it is a principal object of the invention to provide a telescoping work platform having an inner and outer frame or basket where the work platform is carried on the inner basket to provide a safe and stable environment for elevated work sites.

It is another object of the invention to provide a telescoping work platform wherein the outer basket or support frame of the device includes plurality of rungs to allow the user to mount the elevated work platform.

It is a further object of the invention to provide a telescoping work platform wherein means are provided to simply and easily locate and lock the work platform at various heights to accommodate differing situations.

Still another object of the invention is to provide a telescoping work platform where the inner basket includes members that serve as safety rails, allowing the user to shift their weight as desired, without the fear of falling or injury.

Yet another object of the invention is to provide a telescoping work platform wherein the inner basket includes an adjustable height tool shelf.

It is a major goal of the invention to provide improved elements and arrangements thereof in an apparatus for the purposes described which is inexpensive, dependable and fully effective in accomplishing its intended purposes.

The present invention meets or exceeds all the above objects and goals. Upon further study of the specification and appended claims, further objects and advantages of this invention will become apparent to those skilled in the art.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 1 is a perspective view of the present invention in a configuration that allows it to be wheeled from one location to the other.

FIG. 2 is an exploded perspective view showing how the inner basket or work platform frame fits inside the outer basket.

FIG. 3 is a perspective view of the wheeled embodiment of the present invention with the handle members serving as supplementary braces.

FIG. 4 is a partial view of the work platform of the present invention showing an integral locking device in an unlocked position.

FIG. 5 is a partial view of the work platform of the present invention showing the integral locking device in a locked position.

FIG. 6 is a view of an alternative embodiment of the work platform positioning apparatus where a "jack" type of device is used to move the work platform up and down in relation to the outer frame.

FIG. 7 is a perspective view of another embodiment of the invention where a sliding safety brace is included for added stability.

DETAILED DESCRIPTION OF THE PREFERRED EMBODIMENTS

The present invention is indicated in the drawings generally at 10. The telescoping work platform 10 has an outer frame or basket 12 and an inner frame 14 that includes a work platform 16. This is clearly seen in FIG. 2. The outer frame 12 has a base 20, four outer vertical angle supports 22, 24, 26, 28, and connecting struts 29 for added strength. The inner frame 14 similarly has four inner vertical angle supports 30, 32, 34, 36 rising from the work platform 16. The outer vertical support members 24 and 26 define an access opening, being the space between vertical supports 24 and 26 of the outer frame and vertical supports 32 and 34 of the inner frame, to permit lateral access of a user to the inner space of the outer frame by a user. The connecting struts 29 of the outer frame and 48 of the inner frame are located on only three sides of the respective flames to further define the access opening. The inner frame 14 is dimensioned such that the inner vertical supports 30, 32, 34, 36 are in slidable contact with their corresponding outer angle supports 22, 24, 26, 28 as can be seen in FIG. 3. The interengagement of the inner and outer vertical supports will be discussed further below. The inner frame defines an access opening corresponding with the access opening of the outer frame so that at any position of the inner frame relative to the outer frame a person using the telescoping work platform will have access to the work platform 16 for ingress to and egress from the protected work space above the work platform. It should be clear that the outer frame must be made of a heavy material as it needs to support the weight of the user, tools, and the inner frame. Various alloys of aluminum would provide the necessary strength without adding prohibitive weight to the device 10. Of course, other materials could be used. Another portion of the device that requires special strength is the work platform 16 and the inner supports 30, 32, 34, 36 which have to support the user's weight and the weight of any tools that may be present. Referring to FIGS. 1–3, the embodiment shown in these views is equipped with wheels W and a pair of pivoting handles 40 and 42. The handles 40, 42 are pivoted and locked into an upright position when the device 10 is to be wheeled from one location to another, as is seen in FIG. 1. The locking means shown in this embodiment is a simple pin arrangement 44 seen in FIGS. 1 and 2. Other securing methods would of course be obvious to a skilled artisan. When the device 10 is in the desired location, as seen in FIG. 3, the handles 40, 42 can be pivoted to the position shown and secured as additional braces by the pin arrangement 46. At the top of the inner frame 14, there are three safety rails 48 extending from the tops of the inner vertical supports 30, 32, 34, and 36. These rails can be made of a lighter material as it is not necessary for them to bear any load. It is contemplated that a strong polymer material could be utilized. The fourth safety rail 49 is positioned at the "back" of the platform and it is contemplated that it could include a hinge (not shown) to allow it to be swung free for entrance and exit from the working platform 16. Also shown spanning a pair the outer vertical supports are ladder rungs 100. It is contemplated that these could also be pivotally attached at one point as is indicated at 110 in FIG. 2. Located at the top of the inner frame is an adjustable tool shelf 50. The shelf 50 is supported, in the embodiment described herein, by a pair of slidable rods or tubes 52. These rods or tubes 52 allow the shelf 50 to be positioned at a desired level.

Turning now to FIGS. 4 and 5, there is shown a slidable work platform engagement means that is integral to the work platform 16. This engagement means consists of a generally rectangular handle portion 60 made of tubular stock material. There are two pairs of protruding engagement horns 62, 64 extending from the handle portion 60 proximate the gripping ends 66, 68 thereof. This arrangement allows the user to easily lock the work platform 16 into engagement with the outer vertical supports 22, 24, 26, 28 of the outer frame 12 by having the engagement horns 62, 64 slide into the apertures A that are spaced on the outer vertical supports 22, 24, 26, 28 as can be seen in FIG. 5.

Another alternative to the engagement means is seen in FIG. 6. In this embodiment, the work platform 16 and the outer vertical supports 22, 24, 26, 28 are interconnected through a jack type means that allows the user to raise and lower the work platform by depressing a pedal 70. A switch (not shown) would allow the user to select whether the depressing of the pedal 70 would impel the work platform 16 up or allow it to descend.

Another embodiment of the invention is seen in FIG. 7. In this embodiment an additional brace 80 is pivotally attached to an outer vertical support 22 at a pivot point 82 and is selectively positionable at an extended or deployed position as shown in FIG. 7 for stabilization of the outer frame and for essentially increasing the effective dimension of the base for additional stability thereof. A second pivot point 84 is connected to a horizontal sliding member 86 that is held in the desired position in relation to the outer vertical support by a brace pin 88.

A list of the reference numerals referred to in the above specification follows:

| | |
|---|---|
| telescoping work platform | 10 |
| outer frame | 12 |
| inner frame | 14 |
| work platform | 16 |
| outer frame base | 20 |
| outer vertical angle supports | 22 |
| outer vertical angle supports | 24 |
| outer vertical angle supports | 26 |
| outer vertical angle supports | 28 |
| outer connecting struts | 29 |
| inner vertical angle supports | 30 |
| inner vertical angle supports | 32 |
| inner vertical angle supports | 34 |
| inner vertical angle supports | 36 |

-continued

| | |
|---|---|
| wheels | W |
| pivoting handles | 40 |
| pivoting handles | 42 |
| pin arrangement | 44 |
| brace pin arrangement | 46 |
| safety rails | 48 |
| pivoting safety rail | 49 |
| ladder rungs | 100 |
| rung pivot point | 110 |
| adjustable tool shelf | 50 |
| tool shelf rods | 52 |
| engagement handle | 60 |
| engagement horns | 62 |
| engagement horns | 64 |
| handle gripping ends | 66 |
| handle gripping ends | 68 |
| jack pedal | 70 |
| supplementary brace | 80 |
| 1st brace pivot point | 82 |
| 2nd brace pivot point | 84 |
| brace slide member | 86 |
| supplementary brace pin | 88 |

It is to be understood that the present invention is not limited to the sole embodiment described above, but encompasses any and all embodiments within the scope of the following claims.

I claim:

1. A telescoping work platform comprising:

(a) an outer frame including a base adapted to rest on a support surface and having a plurality of outer vertical support members integrally connected to said base;

(b) an inner frame defining upper and lower ends and having a work platform at said lower end and having a plurality of inner vertical support members integrally connected to said work platform and extending vertically thereabove, said inner frame adapted to nest telescopically within said outer frame such that each of said outer vertical support members is parallel and proximate with a corresponding one of said inner vertical support members;

(c) means for releasably locking said inner vertical support members and said outer vertical support members in selectively positioned relation such that said inner vertical support members are secured in a predetermined position in relation to said outer vertical support members thus positioning said work platform at a selected height above said base of said outer frame and thus, the support surface on which said base rests; and (d) a plurality of ladder rungs being connected in vertically spaced relation to said outer frame and being selectively ;pivotal relative to said outer frame to permit user access to said work platform.

2. The work platform of claim 1, wherein said inner frame includes a substantially horizontal tool shelf attached to and extending from said inner frame, said substantially horizontal tool shelf being located at said upper end of said inner frame and thus being positioned above said work platform.

3. The work platform of claim 2, wherein said tool shelf being vertically adjustable in relation to said work platform.

4. The telescoping work platform of claim 3, further comprising:

safety rails being interconnected with said inner vertical supports for stabilizing the same and for providing for lateral support of a user when the user is standing on said work platform.

5. The telescoping work platform of claim 4, wherein:

one of said safety rails being pivotally mounted to one of said inner vertical supports and having a safety position and an access position relative to said one of said inner vertical supports to provide lateral support for the user and to permit access to said work platform by the user.

6. The telescoping work platform of claim 4, wherein:

said horizontal tool shelf being movably supported by at least one of said safety rails.

7. The telescoping work platform of claim 1, wherein:

said ladder rungs are each pivotally mounted to at least one of said outer vertical support members and being selectively lockable against pivotal movement relative to said outer vertical support members for support of the weight of a user when the user is ascending or descending the telescoping work platform.

8. The telescoping work platform of claim 1, wherein:

(a) said outer vertical support members each define positioning apertures; and (b) said work support platform having locking means in movable relation thereto for entering selected ones of said positioning apertures and securing said work support platform in selectively positioned relation with said outer frame.

9. The telescoping work platform of claim 1, further comprising:

jack means being interconnected with said inner and outer frames and being selectively operable for raising an lowering said inner frame relative to said outer frame.

10. A telescoping work platform, comprising:

(a) an outer frame defining an outer frame space and having a base adapted to rest upon a support surface and having a plurality of outer vertical support members extending upwardly from said base and having upper ends, said base and two of said outer vertical support members of said outer frame defining an access opening permitting lateral access of a user to said outer frame space;

(b) an inner frame defining upper and lower ends and being received in selectively positionable telescoping assembly within said outer frame and having a work platform adapted for support of a user, said inner frame further having a plurality of inner vertical support elements extending upwardly from said work platform, said inner frame defining an access opening corresponding with said access opening of said outer frame, safety rails being provided at the upper end of said inner frame;

(c) locking means being positionable in locking engagement with said inner and outer flames for releasably securing said inner and outer flames at selected relative positions; and (d) a plurality of ladder rungs being connected in vertically spaced relation to said outer frame and being selectively positionable at access positions permitting ingress and egress of a user through said access openings of said inner and outer flames and fixed positions for supporting the weight of a user to permit climbing of said outer frame.

11. The telescoping work platform of claim 10, further comprising:

(a) handle means being pivotally connected to said outer frame and being positionable at a deployed position substantially horizontally oriented relative to said outer frame for stabilizing engagement with the support surface on which said base rests and being selectively positionable at a retracted position relative to said outer frame; and (b) wheel means being mounted to said handle means and at said desployed position of said handle means said wheel means being retracted to a position out of engagement with said support surface and at said retracted position of said handle means, said wheel means being extended to a position for transporting engagement with said support surface.

12. The telescoping work platform of claim 11, wherein:

said ladder rungs each being pivotally mounted to at least one of said outer vertical support members and being selectively lockable against pivotal movement relative to said outer vertical support members for support of the weight of a user when the user is ascending or descending the telescoping work platform.

13. The telescoping work platform of claim 11, wherein said safety rails are interconnected with said inner vertical supports for stabilizing the same and for providing for lateral support of a user when the user is standing on said work platform.

14. The telescoping work platform of claim 13, wherein:

one of said safety rails being pivotally mounted to one of said inner vertical supports and having a safety position and an access position relative to said one of said inner vertical supports to provide lateral support for the user and to permit access to said work platform by the user.

* * * * *